US010239122B2

(12) United States Patent
Rioux et al.

(10) Patent No.: US 10,239,122 B2
(45) Date of Patent: Mar. 26, 2019

(54) ALLOY NANOPARTICLES, PROCESS FOR THEIR PREPARATION AND USE THEREOF

(71) Applicant: POLYVALOR, SOCIÉTÉ EN COMMANDITE, Montreal (CA)

(72) Inventors: David Rioux, Montreal (CA); Michel Meunier, Pierrefonds (CA)

(73) Assignee: POLYVALOR, SOCIÉTÉ EN COMMANDITE, Montreal (CA)

( * ) Notice: Subject to any disclaimer, the term of this patent is extended or adjusted under 35 U.S.C. 154(b) by 0 days.

(21) Appl. No.: 15/054,290

(22) Filed: Feb. 26, 2016

(65) Prior Publication Data

US 2016/0256930 A1 Sep. 8, 2016

Related U.S. Application Data

(60) Provisional application No. 62/126,947, filed on Mar. 2, 2015.

(51) Int. Cl.

| | |
|---|---|
| ***B22F 1/02*** | (2006.01) |
| ***B22F 9/24*** | (2006.01) |
| ***B22F 1/00*** | (2006.01) |

(52) U.S. Cl.

CPC ..... *B22F 9/24* (2013.01); *B22F 1/0044* (2013.01); *B22F 1/025* (2013.01); *B22F 2301/255* (2013.01); *B22F 2304/054* (2013.01); *B22F 2304/056* (2013.01); *B22F 2999/00* (2013.01)

(58) Field of Classification Search

None

See application file for complete search history.

(56) References Cited

U.S. PATENT DOCUMENTS

| | | | | |
|---|---|---|---|---|
| 7,524,354 | B2 | 4/2009 | Zhong et al. | |
| 2006/0070491 | A1* | 4/2006 | Yang | B22F 1/0018 75/255 |
| 2007/0290175 | A1* | 12/2007 | Kim | B22F 1/0018 252/500 |
| 2010/0086832 | A1* | 4/2010 | Lopez | B22F 1/0018 429/409 |

(Continued)

FOREIGN PATENT DOCUMENTS

| | | | | |
|---|---|---|---|---|
| WO | 01/39873 | A1 | 6/2001 | |
| WO | WO2014041705 | * | 2/2014 | B22F 9/24 |
| WO | 2014/052654 | A1 | 4/2014 | |

OTHER PUBLICATIONS

Zhang et al., "Synthesis of Ag@AgAu Metal Core/Alloy Shell Bimetallic Nanoparticles with Tunable Shell Compositions by a Galvanic Replacement Reaction", Jul. 2008, Small, vol. 4, pp. 1067-1071.*

(Continued)

*Primary Examiner* — Seth Dumbris

(74) *Attorney, Agent, or Firm* — Beatrice Ngatcha

(57) ABSTRACT

There is provided a process for preparing alloy nanoparticles having a desired size. The process comprises a combination of co-reduction of metal salts in the presence of a reducing agent, and multi-step seeded growth synthesis. Also provided is a material which comprises alloy nanoparticles made of at least two metals. A mean diameter of the particles of the material is between about 30 nm and 200 nm as measured by transmission electron microscopy (TEM), and the particles have a coefficient of variation smaller than about 15%.

7 Claims, 12 Drawing Sheets

(56) References Cited

U.S. PATENT DOCUMENTS

2010/0155310 A1* 6/2010 Enomura ..... B01F 3/0807 209/668
2012/0108451 A1* 5/2012 Li ..... B82Y 15/00 506/9
2012/0295110 A1 11/2012 Arquilliere et al.
2013/0053239 A1 2/2013 Carpenter
2015/0246395 A1* 9/2015 Maekawa ..... B22F 9/24 75/370

OTHER PUBLICATIONS

Abhijith, K. S.; Sharma, R.; Ranjan, R.; Thakur, M. S. Facile synthesis of gold-silver alloy nanoparticles for application in metal enhanced bioluminescence. Photochem. Photobiol. Sci. (2014), 13, 986-991.
Abhijith, K. S.; Sharma, R.; Ranjan, R.; Thakur, M. S. Electronic Supplementary Material (ESI) for Photochemical & Photobiological Sciences. 2014.
Besner, S.; Meunier, M. Femtosecond Laser Synthesis of AuAg Nanoalloys: Photoinduced Oxidation and Ions Release. J. Phys. Chem. C (2010), 114, 10403-10409.
Brown, K. R.; Natan, M. J. Hydroxylamine Seeding of Colloidal Au Nanoparticles in Solution and on Surfaces. Langmuir (1998), 14, 726-728.
Brown, K. R.; Walter, D. G.; Natan, M. J. Seeding of Colloidal Au Nanoparticle Solutions. 2. Improved Control of Particle Size and Shape. Chem. Mater. (2000), 12, 306-313.
Chen, J.; McLellan, J. M.; Siekkinen, A.; Xiong, Y.; Li, Z.-Y.; Xia, Y. Facile Synthesis of Gold-Silver Nanocages with Controllable Pores on the Surface. J. Am. Chem. Soc. (2006), 128, 14776-14777.
Fairbairn, N.; Christofidou, A.; Kanaras, A. G.; Newman, T. A; Muskens, O. L. Hyperspectral Darkfield Microscopy of Single Hollow Gold Nanoparticles for Biomedical Applications. Phys. Chem. Chem. Phys. (2013), 15, 4163-4168.
Frens, G. Controlled Nucleation for the Regulation of the Particle Size in Monodisperse Gold Suspensions. Nat. Phys. Sci. (1973), 241, 20-22.
Garcia, M. A. Surface Plasmons in Metallic Nanoparticles: Fundamentals and Applications. J. Phys. D: Appl. Phys. (2011), 44, 283001.
Garcia, M. A. Corrigendum: Surface Plasmons in Metallic Nanoparticles: Fundamentals and Applications. J. Phys. D: Appl. Phys. (2013), 45, 389501.
Gonzalez, C. M.; Liu, Y.; Scaiano, J. C. Photochemical Strategies for the Facile Synthesis of Gold-Silver Alloy and Core-Shell Bimetallic Nanoparticles. J. Phys. Chem. C (2009), 113, 11861-11867.
Grade, S.; Eberhard, J.; Jakobi J.; Winkel, A.; Stiesch, M.; Barcikowski S. Alloying Colloidal Silver Nanoparticles with Gold Disproportionally Controls Antibacterial and Toxic Effects. Gold Bull. (2014), 47, 83-93.
Jain, P. K.; Lee K. S.; El-Sayed, I. H.; El-Sayed, M. A. Calculated Absorption and Scattering Properties of Gold Nanoparticles of Different Size, Shape, and Composition: Applications in Biological Imaging and Biomedicine. J. Phys. Chem. B (2006), 110, 7238-7248.
Ji, X.; Song, X.; Li, J.; Bai, Y.; Yang, W.; Peng, X. Size Control of Gold Nanocrystals in Citrate Reduction: The Third Role of Citrate. J. Am. Chem. Soc. (2007), 129, 13939-13948.
Li, T.; Albee, B.; Alemayehu, M.; Diaz, R.; Ingham, L.; Kamal, S.; Rodriguez, M.; Bishnoi, S. W. Comparative Toxicity Study of Ag, Au, and Ag-Au Bimetallic Nanoparticles on Daphnia Magna. Anal. Bioanal. Chem. (2010), 398, 689-700.
Link, S.; Wang, Z. L.; El-Sayed, M. A. Alloy Formation of Gold-Silver Nanoparticles and the Dependence of the Plasmon Absorption on Their Composition. J. Phys. Chem. B (1999), 103, 3529-3533.
Liu, S.; Chen, G.; Prasad, P. N.; Swihart, M. T. Synthesis of Monodisperse Au, Ag, and Au-Ag Alloy Nanoparticles with Tunable Size and Surface Plasmon Resonance Frequency. Chem. Mater. (2011), 23, 4098-4101.
Mahl, D.; Diendorf, J.; Ristig, S.; Greulich, C.; Li, Z.-A.; Farle, M.; Köller, M.; Epple, M. Silver, Gold, and Alloyed Silver-gold Nanoparticles: Characterization and Comparative Cell-Biologic Action. J. Nanopart. Res. (2012), 14, 1153. DOI: 10.1007/s11051-012-1153-5.
Mallin, M. P.; Murphy, C. J. Solution-Phase Synthesis of Sub-10 Nm Au—Ag Alloy Nanoparticles. Nano Lett. (2002), 2, 1235-1237.
Mie, G. Beitrage Zur Optik Trüber Medien, Speziell Kolloidaler Metallösungen. Ann. Phys. (1908), 330, 377-445.
Murphy, C. J.; Sau, T. K.; Gole, A. M.; Orendorff, C. J.; Gao, J.; Gou, L.; Hunyadi, S. E.; Li, T. Anisotropic Metal Nanoparticles: Synthesis, Assembly, and Optical Applications. J. Phys. Chem. B (2005), 109, 13857-13870.
Navarro, J. R. G.; Werts, M. H. V. Resonant Light Scattering Spectroscopy of Gold, Silver, and Gold-Silver Alloy Nanoparticles and Optical Detection in microfluidic Channels. Analyst (2013), 138, 583-592.
Navarro, J. R. G.; Werts, M. H. V. Supporting information for 'Resonant light scattering spectroscopy of gold, silver and gold-silver alloy nanoparticles and optical detection in microfluidic channels' (2013), SI-1/18-SI-18/18.
Neumeister, A.; Jakobi, J.; Rehbock, C.; Moysig, J.; Barcikowski, S. Monophasic Ligand-Free Alloy Nanoparticle Synthesis Determinants during Pulsed Laser Ablation of Bulk Alloy and Consolidated Microparticles in Water. Phys. Chem. Chem. Phys. (2014), 16, 23671-23678.
Pal, A; Shah, S.; Devi, S. Preparation of Silver-Gold Alloy Nanoparticles at Higher Concentration Using Sodium Docdecyl Sulfate. Aust. J. Chem. (2008), 61, 66-71.
Patskovsky, S.; Bergeron, E.; Meunier, M. Hyperspectral Darkfield Microscopy of PEGylated Gold Nanoparticles Targeting CD44-Expressing Cancer Cells. J. Biophotonics (2013), 6, 1-6.—DOI: Oct. 10-1002/ bio.201300165.
Patskovsky, S.; Bergeron, E.; Rioux, D.; Meunier, M. Wide-Field Hyperspectral 3D Imaging of Functionalized Gold Nanoparticles Targeting Cancer Cells by Reflected Light Microscopy. J. Biophotonics (2014), DOI: 10.1002/jbio.201400025.
Patskovsky, S.; Bergeron, E.; Rioux, D.; Simard, M.; Meunier, M. Hyperspectral Reflected Light Microscopy of Plasmonic Au/Ag Alloy Nanoparticles Incubated as Multiplex Chromatic Biomarkers with Cancer Cells. Analyst (2014), 139, 5247-5253.
Peng, Z.; Spliethoff, B.; Tesche, B.; Walther, T.; Kleinermanns, K. Laser-Assisted Synthesis of Au—Ag Alloy Nanoparticles in Solution. J. Phys. Chem. B (2006), 110, 2549-2554.
Perrault, S. D.; Chan, W. C. W. Synthesis and Surface Modification of Highly Monodispersed, Spherical Gold Nanoparticles of 50-200 nm. J. Am. Chem. Soc. (2009), 131, 17042-17043.
Radziuk, D. V.; Zhang, W.; Shchukin D.; Möhwald, H. Ultrasonic Alloying of Preformed Gold and Silver Nanoparticles. Small (2010), 6, 545-553.
Rioux, D.; Vallières, S.; Besner, S.; Muñoz, P.; Mazur, E.; Meunier, M. An Analytic Model for the Dielectric Function of Au, Ag, and Their Alloys. Adv. Opt. Mater. (2013), DOI: 10.1002/adom.201300457.
Rodriguez-González, B.; Burrows, A.; Watanabe, M.; Kiely, C. J.; Liz Marzán, L. M. Multishell Bimetallic AuAg Nanoparticles: Synthesis, Structure and Optical Properties. J. Mater. Chem. (2005), 15, 1755-1759.
Russier-Antoine, I.; Bachelier, G.; Sablonière, V.; Duboisset J.; Benichou, E.; Jonin, C.; Bertorelle, F.; Brevet, P.-F. Surface Heterogeneity in Au—Ag Nanoparticles Probed by Hyper-Rayleigh Scattering. Physical Review B (2008), 78, 035436.
Salehi K., A. H.; Montazer, M,; Toliyat, T. Synthesis and Characterization of Au:Ag Nanoparticles Using Trisodium citrate and SDS. Synthesis and Reactivity in Inorganic, Metal-Organic, and Nano-Metal Chemistry (2014), 44, 1421-1425, DOI: 10.1080/15533174.2013.809738.
Sánchez-Ramirez, J. F.; Pal, U.; Nolasco-Hernández, L.; Mendoza-Álvarez, J.; Pescador-Rojas, J.A. Synthesis and Optical Properties

(56) References Cited

OTHER PUBLICATIONS of Au—Ag Alloy Nanoclusters with Controlled Composition. J. Nanomater. (2008), DOI: 10.1155/2008/620412.
Shore, M. S.; Wang, J.; Johnston-Peck, A. C.; Oldenburg, A. L.; Tracy, J. B. Synthesis of Au(Core)/Ag (Shell) Nanoparticles and Their Conversion to AuAg Alloy Nanoparticles. Small (2011), 7, 230-234.
Skrabalak, S. E.; Chen, J.; Au, L.; Lu, X.; Li, X.; Xia, Y. Gold Nanocages for Biomedical Applications. Adv. Mater. (2007), 19, 3177-3184.
Šrnová-Šloufová, I.; Vlčková, B.; Bastl, Z.; Hasslett, T. L. Bimetallic (Ag)Au Nanoparticles Prepared by the Seed Growth Method : Two-Dimensional Assembling, Characterization by Energy Dispersive X-Ray Analysis, X-ray Photoelectron spectrosicipy, and Surface Enhanced Raman Spectroscopy, and Proposed Mechanism of Growth. Langmuir (2004). 20, 3407-3415.
Stockman, M. I. Nanoplasmonics: The Physics Behind the Applications. Phys. Today (2011), 64, 39-44.
Tiedemann, D.; Taylor, U.; Rehbock, C.; Jakobi, J.; Klein, S.; Kues, W. A.; Barcikowski, S.; Rath, D. Reprotoxicity of Gold, Silver, and Gold-Silver Alloy Nanoparticles on Mammalian Gametes. Analyst (2014), 139, 931-942.
Turkevich, J.; Stevenson, P. C.; Hillier, J. A Study of the Nucleation and Growth Processes in the Synthesis of Colloidal Gold. Discuss. Faraday Soc. (1951), 11, 55-75.
Wan, Y.; Guo, Z.; Jiang, X.; Fang, K.; Lu, X.; Zhang, Y.; Gu, N. Quasi-Spherical Silver Nanoparticles: Aqueous Synthesis and Size Control by the Seed-Mediated Lee-Meisel Method. J. Colloid Interface Sci. (2013), 394, 263-268.
Xia, H.; Bai, S.; Hartmann, J.; Wang, D. Synthesis of Monodisperse Quasi-Spherical Gold Nanoparticles in Water via silver(I)-Assisted Citrate Reduction. Langmuir 2010, 26, 3585-3589.
Zhang, Q.; Xie, J.; Liang, J.; Lee, J. Y. Synthesis of Monodisperse Ag—Au Alloy Nanoparticles with Independently Tunable Morphology, Composition, Size, and Surface Chemistry and Their 3-D Superlattices. Adv. Fund. Mater. (2009), 19, 1387-1398.
Ziegler, C.; Eychmüller, A. Seeded Growth Synthesis of Uniform Gold Nanoparticles with Diameters of 15-300 nm. J. Phys. Chem. C (2011), 115, 4502-4506.

* cited by examiner

ALLOY NANOPARTICLES, PROCESS FOR THEIR PREPARATION AND USE THEREOF

CROSS REFERENCE TO RELATED APPLICATIONS

This application claims benefit, under 35 U.S.C. § 119(e), of U.S. provisional application Ser. No. 62/126,947, filed on Mar. 2, 2015, the content of which is herein incorporated in its entirety by reference.

FIELD OF THE INVENTION

The invention relates to alloy nanoparticles (ANPs). More specifically, the invention relates to a process for the preparation of ANPs, which allows for the control of the particles size and the alloy composition. The ANPs of the invention are substantially spherical and monodispersed in aqueous solution.

BACKGROUND OF THE INVENTION

In recent years, the field of plasmonics has been flourishing with new advances and discoveries. There has been tremendous development on new geometries for nanoparticles (NPs) or for nanostructured surfaces in order to control the optical properties or obtain new functionalities [1-4]. Surprisingly, the development in terms of material used for these nanostructures has been much more limited as most applications of plasmonics use either gold (Au) or silver (Ag). These two metals have the best plasmonic resonance, and although Ag has better plasmonic properties [2], Au is biocompatible and has a better stability and resistance to oxidation, making it a better candidate for several applications [5]. In either case, the control of the optical properties of the plasmonic nanomaterials can only be obtained through a fine control of the geometry using, for instance, nanorods, nanotriangles, or nanoshells rather than spherical NPs. However, the optical properties are generally sensitive to the shape of the NPs [3], making it important to obtain suspensions with good uniformity in size and shape. Therefore, it would be interesting to keep spherical NPs and to control their optical properties by changing the material composition instead of the shape. Because Au and Ag are good plasmonic metals, their alloys are a logical choice for a new material. Gold-silver (AuAg) alloy nanoparticles are interesting because their plasmonic resonance peak can be tuned with the alloy composition [6].

Synthesis of AuAg ANPs has been reported by ultrasonic alloying of Au and Ag NPs [7], by laser alloying of Au and Ag NPs [6,8], by laser ablation of a solid AuAg alloy target [5,9], by photochemical co-reduction of Au and Ag salts [10], or by using conventional chemical reduction methods in organic solvents [11-13] or aqueous solutions [14-19]. In every case, the plasmon peak position was found to vary almost linearly with alloy composition. Other ANPs syntheses are known in the art [39,40]. However, in these approaches, size control of the particles is not always achieved. Moreover, the mean diameter of the particles is generally smaller than 30 nm.

In plasmonic applications, large particles (for example >50 nm) are often needed in order to benefit from their high light scattering efficiency. For example, suitably large AuAg ANPs with different compositions can act as chromatic biomarkers in biomedical imaging [20-22].

There is a need for alloy nanoparticles having larger sizes, for example sizes larger than 30 nm. There is a need for processes for the preparation of alloy nanoparticles, which allow for the control of the particles size. Also, there is a need for processes which allow for the control of the alloy composition.

SUMMARY OF THE INVENTION

The inventors have discovered a process for the preparation of alloy nanoparticles. The process according to the invention allows for the control of the particles size and the alloy composition. The process according to the invention combines the co-reduction of metals for the formation of alloys and the seeded growth synthesis for the formation of size-controlled nanoparticles. The alloy nanoparticles of the invention have a mean diameter between about 30 nm to about 200 nm, preferably between about 50 nm to about 150 nm, more preferably between about 65 nm to about 120 nm. Also, alloy nanoparticles of the invention have a coefficient of variation (CV) lower than about 15%. Moreover, alloy nanoparticles of the invention are substantially spherical and monodispersed in aqueous solution.

The invention thus provides for the following according to aspects thereof:

(1) Process for preparing alloy nanoparticles having a desired size, comprising a combination of: co-reduction of metal salts in the presence of a reducing agent, and multi-step seeded growth synthesis.

(2) Process for preparing alloy nanoparticles having a desired size, comprising:
- (a) providing an initial seed made of nanoparticles of a metal or an alloy of at least two metals;
- (b) simultaneously adding to the seed, salts of the at least two metals and a reducing agent, to obtain alloy nanoparticles having a first size;
- (c) optionally, simultaneously adding to an alloy seed made of the alloy nanoparticles having a first size obtained at step (b), the salts of the at least two metals and the reducing agent, to obtain alloy nanoparticles having a second size; and optionally, repeating step (c) a number of time until the desired size is reached, wherein the alloy seed is made of the alloy nanoparticles obtained at a previous step.

(3) The process of (2) above, wherein the initial seed at step (a) is obtained by the Turkevich approach.

(4) Process of (2) above, which is performed in aqueous solution, at a temperature near the water boiling point, and the reducing agent is a high-temperature reducing agent, such as sodium citrate.

(5) Process of (2) above, which is performed in aqueous solution, at ambient temperature, and the reducing agent is a selected from the group consisting of ascorbic acid, hydroquinone, hydroxylamine and a combination thereof.

(6) Process of (2) above, wherein the metal is selected from the group consisting of Au, Ag, Cu, Pt and Pd.

(7) Process of (2) above, wherein at step (a) the initial seed is selected from Au nanoparticles, Ag nanoparticles and AuAg alloy nanoparticles; and the metal salts are a salt of Au and a salt of Ag.

(8) Process of (2) above, wherein the initial seed particles have a mean diameter of about 2 nm to about 25 nm.

(9) Process of (2) above, wherein a concentration of the reducing agent is about 0.1 mM to 5 mM.

(10) Process of (2) above, wherein the metal salts are selected from the group consisting of chloroauric acid ($HAuCl_4$), silver nitrate ($AgNO_3$), copper nitrate ($Cu(NO_3)_2$), chloroplatinic acid ($H_2PtCl_6$), and palladium chloride ($PdCl_2$).

(11) Process of (2) above, wherein the metal salts are $HAuCl_4$ and $AgNO_3$.

(12) Material comprising alloy nanoparticles made of at least two metals, wherein a mean diameter of the particles is between about 30 nm and 200 nm as measured by transmission electron microscopy (TEM), and the particles have a coefficient of variation smaller than about 15%.

(13) Material of (12) above, wherein the mean diameter of the particles is between about 50 nm and 150 nm.

(14) Material of (12) above, wherein the mean diameter of the particles is between about 65 nm and 120 nm.

(15) Material of (12) above, wherein the particles are substantially spherical and monodispersed in aqueous solution.

(16) Material of (12) above, wherein the particles have an ellipticity between about 1.0 and 1.5.

(17) Material of (12) above, wherein the at least two metals are selected from the group consisting of Au, Ag, Cu, Pt and Pd.

(18) Material of (12) above, wherein a core of each particle is made of one of the at least two metals and a shell of the particle is made of the alloy of the at least two metals.

(19) Material of (12) above, wherein a core of each particle is made of Au and a shell of the particle is made of the Au—Ag alloy.

(20) Material of (12) above, wherein the particles are suitable for attachment to and/or interaction with biological agents including: antibodies, stabilizing polymers such as polyethylene glycol (PEG) and polyvinylpyrrolidone (PVP), Raman-active molecules and dyes.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

Figure 1:
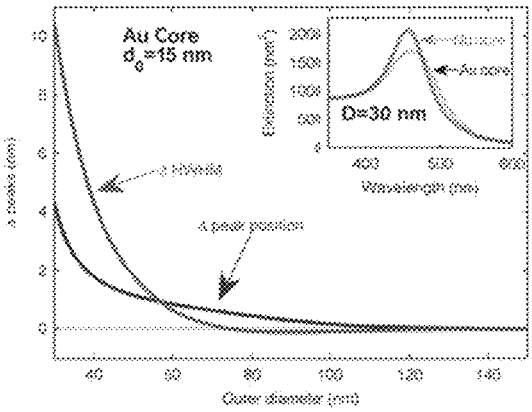
FIG. 1 Difference between the calculated plasmon peak positions (blue) and HWHM (red) of 50:50 AuAg ANPs with a 15 nm diameter Au core and ANPs without a Au core, as a function of outer ANP diameter. The effect of the gold core decreases rapidly with an outer diameter increase and becomes negligible for particles larger than ~50 nm (<2 nm difference in both the positions and HWHM of the peaks). Inset shows the calculated extinction spectra for 30 nm ANP without (green) and with (black) a 15 nm Au core. A homogeneous alloy composition profile was supposed for the calculations.

Before the present invention is further described, it is to be understood that the invention is not limited to the particular embodiments described below, as variations of these embodiments may be made and still fall within the scope of the appended claims. It is also to be understood that the terminology employed is for the purpose of describing particular embodiments, and is not intended to be limiting. Instead, the scope of the present invention will be established by the appended claims.

In order to provide a clear and consistent understanding of the terms used in the present specification, a number of definitions are provided below. Moreover, unless defined otherwise, all technical and scientific terms as used herein have the same meaning as commonly understood to one of ordinary skill in the art to which this invention pertains.

As used herein, the term "seeding" means to use smaller particles, on the surface of which metal ions are added in order to grow larger particles.

As used herein, the term "co-reduction" means to use two or more metal salts added simultaneously in order to produce alloy particles with controlled composition.

As used herein, the term "monodispersed" means a population of particles for which the standard deviation on the size is lower than about 15% of the mean diameter of the particles.

As used herein, the term "spherical" means a population of particles for which the ellipticity, defined as the ratio between the maximum diameter and the minimum diameter of a particle, is between about 1 (perfect sphere) and about 1.5 (ellipsoidal particle).

As used herein, the term "high-temperature reducing agent" means a reducing agent that requires temperatures higher than about 50 C.° for an efficient reduction of the metal salts.

As used herein, the term "particles size" means the diameter of the particles as measured by transmission electron microscopy (TEM).

As used herein, the term "coefficient of variation" (CV) refers to the standard deviation of the size distribution divided by the mean size.

As used herein, the term "about" indicates that a value includes an inherent variation of error for the device or the method being employed to determine the value.

As used herein, the term "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used herein, the terms "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

The inventors have discovered a process for the preparation of alloy nanoparticles. The process according to the invention allows for the control of the particles size and the alloy composition. The process according to the invention combines the co-reduction of metals for the formation of alloys and the seeded growth synthesis for the formation of size-controlled nanoparticles. The alloy nanoparticles of the invention have a mean diameter between about 30 nm to about 200 nm, preferably between about 50 nm to about 150 nm, more preferably between about 65 nm to about 120 nm. Also, alloy nanoparticles of the invention have a coefficient of variation (CV) lower than about 15%. Moreover, alloy nanoparticles of the invention are substantially spherical and monodispersed in aqueous solution.

Chemical Synthesis of Plasmonic NPs.

Of the approaches for NP synthesis known in the art outlined above, chemical reduction is most commonly used. It is based on the reduction of a metal salt transforming the metallic ions into neutral atoms. The low solubility of these free atoms induces their fast nucleation into small metallic clusters, and the remaining neutral atoms then grow on the existing particles. One widely known example of such chemical synthesis for Au NPs is the Turkevich method, where the NPs are formed through reduction of chloroauric acid with sodium citrate in water [23]. In the Turkevich approach, the size of the NPs can be controlled by changing the ratio of Au to citrate during synthesis [24,25]. For small sizes, the Turkevich approach yields NPs with a coefficient of variation (CV, defined as the standard deviation of the size distribution divided by the mean size) lower than 10%, which corresponds to a good monodispersity. However, poor results are obtained regarding the dispersion in size and shape when attempting to produce large (>40 nm) NPs.

An important aspect for the synthesis of monodispersed NPs is the temporal separation of nucleation and growth steps during the NP formation. This has been achieved for both pure Au and pure Ag NPs by using the seeded growth approach which consists of first forming small monodispersed NPs (for example, using the Turkevich approach) and then using them as seeds for the growth of larger NPs. It is important to prevent the formation of new seeds during the growth step. This is achieved by carefully controlling the growth conditions and choosing the appropriate reducing agent. For example, a reducing agent that preferably reduces the ions in the presence of a metallic surface at low temperature will prevent new nucleation [26-28]. Even if the seeded growth approach has been successfully used to synthesize large and size-controlled Au and Ag NPs, this approach has not been shown for AuAg ANPs.

Producing ANPs requires a simultaneous reduction of two or more metal salts. The final composition of the NPs is determined by the initial ratio of the metal salts. However, the nature of each of the metal salts may affect the reaction rate or the metal salts may interfere with each other. This is the case for example between silver nitrate ($AgNO_3$) and chloroauric acid ($HAuCl_4$). It has been noted that if their concentrations are too high, the chlorine ions from the Au salt combine with the Ag ions from the Ag salt to produce silver chloride, which precipitates and do not contribute to particle growth. This precipitation reaction limits the concentration of metal salts that may be used in the formation of the ANPs, therefore limiting the final NP concentration [16].

The inventors have designed and performed a process which allows for the formation of monodispersed and size-controlled ANPs. The process combines the seeded growth synthesis with the co-reduction technique using a reducing agent such as sodium citrate. Since reduction at high temperature may induce undesired nucleation, it is important to control the ratio seed-metals-reducing agent, for example the seed-Au—Ag-citrate ratio during the preparation of AuAg alloy. A metal monomer will be more likely to grow over an existing seed rather that forming a new nucleus if the seed concentration is high. Therefore, it is preferable to use a high seed to metal ion concentration. However, it has been noted that this may limit the final size of the particles. When it is desired to have large NP sizes, a multistep approach for particle growth may be used.

Figure 2:
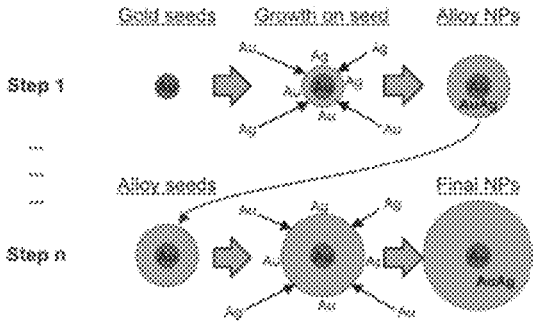
FIG. 2 Schematic of the multistep seeded growth synthesis of ANPs. In the first step, monodispersed Au NPs are used as seeds to grow the thick alloy shell. The resulting ANPs are used as seeds for the subsequent growth step, and the process is repeated until the desired size is reached. The composition and size of the ANPs are determined by the Au and Ag concentrations in the suspension.

In an embodiment of the invention, the method involves the growth of an alloy shell over small Au seed NPs. The Au seed may be produced using the Turkevich approach, which yields monodispersed small NPs. As will be understood by a skilled person, Ag seed NPs or AuAg alloy seeds NPs may also be used. The presence of a small Au seed at the center does not significantly affect the optical properties of the ANP for a diameter larger than ~50 nm. Even at ~30 nm, the theoretical plasmon peak position is only slightly shifted (~4 nm) but the peak is broader; see FIG. 1. FIG. 2 shows the schematics of alloy shell growth on the Au seeds. The resulting ANPs may be used as seeds for subsequent alloy growth, and the process is repeated until the desired size is reached.

EXPERIMENTAL METHODS

All reagents used in the synthesis were purchased from Sigma-Aldrich. The 18 MΩ·cm deionized (DI) water is provided by an EMD Millipore Direct-Q 3 ultrapure water purification system. All glassware was cleaned with aqua regia before particle growth to remove any residual metal from previous synthesis and then rinsed thoroughly with DI water.

Example 1

Au Seed Synthesis.

Synthesis of the Au seed particles was made using a standard Turkevich approach [23]. Briefly, 300 μL of a $HAuCl_4$ solution (30 mM) is added to 28 mL of DI water (18 MΩ·cm) in an Erlenmeyer flask and heated to ebullition (100° C.). While stirring the solution, 200 μL of sodium citrate solution (170 mM) is added rapidly. After a few seconds, the solution becomes transparent before gradually turning to purple and then ruby red. The solution is left heating and stirring for 30 minutes to ensure complete reduction of the Au ions on the NPs. After the process, DI water is added to the solution in order to adjust the total volume to 30 mL. This synthesis method results in a suspension of particles with a diameter of 15±1 nm and a metallic concentration of 300 μM.

Example 2

Seeded Growth Synthesis.

For a given growth step, the final size of the NPs depends on a parameter that we call the "seeding ratio" ($S_r$). This parameter is calculated by dividing the number of Au and Ag atoms in the final suspension of ANPs (alloy shell+initial seed particle) by the number of metal atoms from the seed particles. The $S_r$ is the metric that is used in this disclosure to characterize the seeded growth steps. Assuming complete reduction and deposition of the Au and Ag ions on the seed particles and assuming that they are distributed equally on all the seeds, $S_r$ is also equal to the ratio of the volumes of the final particle $V_f$ and the seed particle $V_{seed}$; therefore:

$$S_R = \frac{V_p}{V_{seed}} = \frac{D^2}{d_0^2} \tag{1}$$

where D and $d_0$ are the diameters of the final and the seed particles respectively; the final diameter D of the NPs may be deduced from equation 1:

$$D = d_0 S_r^{1/2} \tag{2}$$

For NPs produced in a multistep growth, it is important to distinguish between the seeding ratio relative to the initial Au seeds, which we call Total-$S_r$, and the seeding ratio of a given growth step, which we call Step-$S_r$, and for which the seed particle may be a ANP from a previous growth step. The Total-$S_r$ for a particle is therefore the product of the Step-$S_r$ of all steps used for its production.

ANPs are synthesized by adding $HAuCl_4$ and $AgNO_3$ to a dilute suspension of seeds, growing an alloy shell on the seeds. The ratio of $HAuCl_4$ and $AgNO_3$ determines the final composition of the alloy shell. The total metallic concentration (seeds+Au and Ag salts) is 150 μM. A predetermined amount of seeds (for the desired seeding ratio) is added to DI water and heated to ebullition in a three-necked round-bottom flask placed in a water heat bath with refluxing. The total volume of seed suspension and DI water is about 95 mL. At ebullition and with constant stirring (550 rpm), predetermined volumes of $HAuCl_4$ (30 mM) and $AgNO_3$ (30 mM) solution are added simultaneously to the water. Immediately after, 1 mL of sodium citrate solution (170 mM) is added to the solution. The solution is then left heating and stirring for 60 minutes to complete the reaction. The total volume is then adjusted to 100 mL with DI water.

For example, the synthesis of 50:50 ANPs with Total-$S_r$=10 was accomplished by adding 5 mL of the seed suspension into 90 mL of boiling DI water with constant stirring. Afterward, 225 μL of $HAuCl_4$ and 225 μL of $AgNO_3$ were added simultaneously to the boiling solution followed immediately by 900 μL of the sodium citrate solution. For information on the amount of reagents used for the other samples, see Table 1 below.

TABLE 1

Amount of reagents required for the synthesis of the 50:50 Au:Ag samples with different sizes

| | Sample name | | | | | | | |
|---|---|---|---|---|---|---|---|---|
| | S | A1 | A2 | A3 | A4 | A5 | A6 | A7 |
| Seed used | — | S | A1 | A2 | A3 | A4 | A5 | A6 |
| Step Seeding ratio (Step-$S_r$) | — | 10 | 5 | 2 | 2 | 2 | 2 | 2 |
| Total Seeding ratio (Total-$S_r$) | 1 | 10 | 50 | 100 | 200 | 400 | 800 | 1600 |
| Expected size (assuming 15 nm seeds) (nm) | 15 | 32 | 55 | 70 | 88 | 111 | 139 | 175 |

TABLE 1-continued

Amount of reagents required for the synthesis of the 50:50 Au:Ag samples with different sizes

| | Sample name | | | | | | | |
|---|---|---|---|---|---|---|---|---|
| | S | A1 | A2 | A3 | A4 | A5 | A6 | A7 |
| Seed volume (mL) | — | 5 | 20 | 50 | 50 | 50 | 50 | 50 |
| DI water volume (mL) | 29.5 | 93.65 | 78.8 | 49.25 | 49.25 | 49.25 | 49.25 | 49.25 |
| $HAuCl_4$ 30 mM volume (μL) | 300 | 225 | 200 | 125 | 125 | 125 | 125 | 125 |
| $AgNO_3$ 30 mM volume (μL) | 0 | 225 | 200 | 125 | 125 | 125 | 125 | 125 |
| Sodium citrate 170 mM volume (μL) | 200 | 900 | 800 | 500 | 500 | 500 | 500 | 500 |
| Total volume (mL) | 30 | 100 | 100 | 100 | 100 | 100 | 100 | 100 |
| Total concentration (μM) | 300 | 150 | 150 | 150 | 150 | 150 | 150 | 150 |

Example 3

Synthesis of Composition-Controlled ANPs.

In this case, the ANPs were synthesized using the method presented above using two sequential steps: (i) the first step uses the small Au NPs as seeds with a Total-$S_r$=10, and (ii) the second step uses the particles synthesized in the first step as seeds with a Step-$S_r$=10 again, resulting in a Total-$S_r$=100 between the final particles and the initial Au seeds. For each step, the volumes of Au and Ag precursor solutions are adjusted for the desired final alloy composition. For this experiment, ANPs with compositions ranging from pure Au to pure Ag in 10% Ag composition increments were synthesized.

For example, the synthesis of 20:80 AuAg ANPs with Total-$S_r$=10 was accomplished by adding 5 mL of the seed suspension into 90 mL of DI water heated to ebullition with constant stirring. Afterward, 90 μL of $HAuCl_4$ and 360 μL of $AgNO_3$ were added simultaneously to the boiling solution followed immediately by 900 μL of the sodium citrate solution. The final volume was adjusted to 100 mL with DI water.

Afterward, the 20:80 AuAg ANPs with Total-$S_r$=100 were synthesized by adding 10 mL of the previous suspension into 85 mL of DI water heated to ebullition with constant stirring. Then 90 μL of $HAuCl_4$ and 360 μL of $AgNO_3$ were added simultaneously to the boiling solution followed immediately by 900 μL of the sodium citrate solution. The final volume was adjusted to 100 mL with DI water. For information on the amount of reagents used for the other samples, see Table 2 and Table 3 below.

TABLE 2

Amount of reagents required for the synthesis of the ANP samples with different compositions and Total-$S_r$ = 10

| | Sample name | | | | | | | | | | | |
|---|---|---|---|---|---|---|---|---|---|---|---|---|
| | S | $A_{0:100}$ 10 | $A_{10:90}$ 10 | $A_{20:80}$ 10 | $A_{30:70}$ 10 | $A_{40:60}$ 10 | $A_{50:50}$ 10 | $A_{60:40}$ 10 | $A_{70:30}$ 10 | $A_{80:20}$ 10 | $A_{90:10}$ 10 | $A_{100:0}$ 10 |
| Seed used | — | S | S | S | S | S | S | S | S | S | S | S |
| Step Seeding ratio (Step-$S_r$) | — | 10 | 10 | 10 | 10 | 10 | 10 | 10 | 10 | 10 | 10 | 10 |
| Total Seeding ratio (Total-$S_r$) | 1 | 10 | 10 | 10 | 10 | 10 | 10 | 10 | 10 | 10 | 10 | 10 |
| Seed volume (mL) | — | 5 | 5 | 5 | 5 | 5 | 5 | 5 | 5 | 5 | 5 | 5 |
| DI water volume (mL) | 29.5 | 93.65 | 93.65 | 93.65 | 93.65 | 93.65 | 93.65 | 93.65 | 93.65 | 93.65 | 93.65 | 93.65 |
| $HAuCl_4$ 30 mM volume (μL) | 300 | 0 | 45 | 90 | 135 | 180 | 225 | 270 | 315 | 360 | 405 | 450 |
| $AgNO_3$ 30 mM volume (μL) | 0 | 450 | 405 | 360 | 315 | 270 | 225 | 180 | 135 | 90 | 45 | 0 |
| Na citrate 170 mM volume (μL) | 200 | 900 | 900 | 900 | 900 | 900 | 900 | 900 | 900 | 900 | 900 | 900 |
| Total volume (mL) | 30 | 100 | 100 | 100 | 100 | 100 | 100 | 100 | 100 | 100 | 100 | 100 |
| Total concentration (μM) | 300 | 150 | 150 | 150 | 150 | 150 | 150 | 150 | 150 | 150 | 150 | 150 |

TABLE 3

Amount of reagents required for the synthesis of the ANP samples with different compositions and Total-$S_r$ = 100

| | Sample name | | | | | | | | | | |
|---|---|---|---|---|---|---|---|---|---|---|---|
| | $A_{0:100}$ 100 | $A_{10:90}$ 100 | $A_{20:80}$ 100 | $A_{30:70}$ 100 | $A_{40:60}$ 100 | $A_{50:50}$ 100 | $A_{60:40}$ 100 | $A_{70:30}$ 100 | $A_{80:20}$ 100 | $A_{90:10}$ 100 | $A_{100:0}$ 100 |
| Seed used | $A_{0:100}$ 10x | $A_{10:90}$ 10x | $A_{20:80}$ 10x | $A_{30:70}$ 10x | $A_{40:60}$ 10x | $A_{50:50}$ 10x | $A_{60:40}$ 10x | $A_{70:30}$ 10x | $A_{80:20}$ 10x | $A_{90:10}$ 10x | $A_{100:0}$ 10x |
| Step Seeding ratio (Step-$S_r$) | 10 | 10 | 10 | 10 | 10 | 10 | 10 | 10 | 10 | 10 | 10 |
| Total Seeding ratio (Total-$S_r$) | 100 | 100 | 100 | 100 | 100 | 100 | 100 | 100 | 100 | 100 | 100 |
| Seed volume (mL) | 5 | 5 | 5 | 5 | 5 | 5 | 5 | 5 | 5 | 5 | 5 |
| DI water volume (mL) | 93.65 | 93.65 | 93.65 | 93.65 | 93.65 | 93.65 | 93.65 | 93.65 | 93.65 | 93.65 | 93.65 |
| $HAuCl_4$ 30 mM volume (μL) | 0 | 45 | 90 | 135 | 180 | 225 | 270 | 315 | 360 | 405 | 450 |
| $AgNO_3$ 30 mM volume (μL) | 450 | 405 | 360 | 315 | 270 | 225 | 180 | 135 | 90 | 45 | 0 |
| Na Citrate 170 mM volume (μL) | 900 | 900 | 900 | 900 | 900 | 900 | 900 | 900 | 900 | 900 | 900 |
| Total volume (mL) | 100 | 100 | 100 | 100 | 100 | 100 | 100 | 100 | 100 | 100 | 100 |
| Total concentration (μM) | 150 | 150 | 150 | 150 | 150 | 150 | 150 | 150 | 150 | 150 | 150 |

Characterization of the Samples.

Extinction spectra were measured using a multiplate spectrophotometer (BioTek, Epoch). Imaging of the NPs was performed using a TEM (JEM-2100F, JEOL) with a 200 kV accelerating voltage. For the TEM sample preparation, 5 μL of the samples was dropped on a 400 mesh copper grid coated with a thin carbon film (Cu-400CN, Pacific grid tech) and dried before imaging. This TEM is also equipped with an X-ray detector to perform EDS in order to measure the composition of the ANPs. The electron beam diameter was 1 nm for the point composition measurements.

Results and Discussion

Seeded Growth Synthesis of Size-Controlled ANPs.

Figure 3:
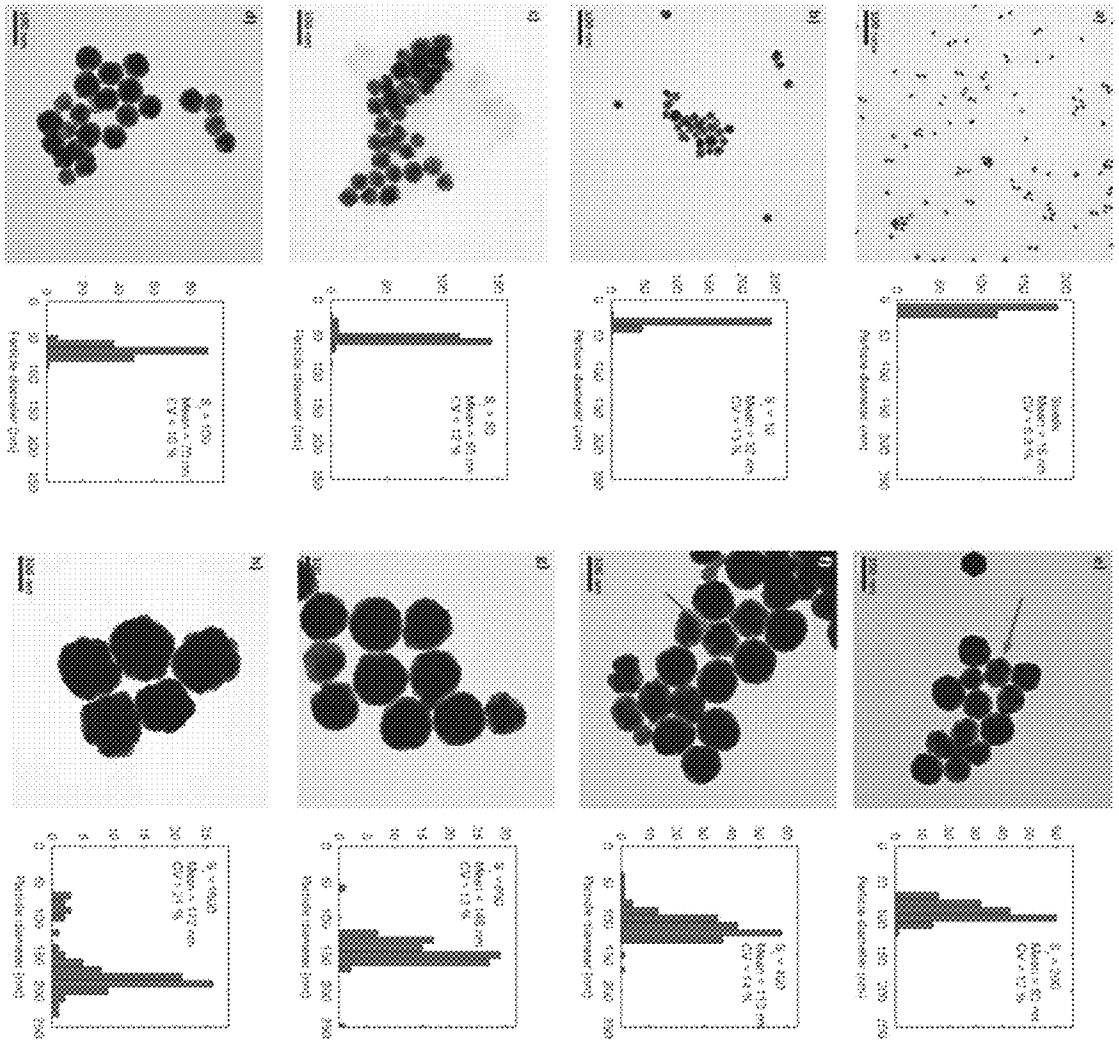
FIG. 3 TEM images and the corresponding size distributions for: a) Au seed particles and for AuAg 50:50 ANPs produced in multistep seeded growth using different Total-$S_r$: b) 10, c) 50, d) 100, e) 200, f) 400, g) 800 and h) 1600.

FIG. 3 shows transmission electron microscope (TEM) images and the size distributions measured for the Au seed NPs as well as the 50:50 ANPs with increasing sizes. All of these NPs were synthesized using multistep growth where the particles with Total-$S_r$=10 were used as seeds for particles with Total-$S_r$=50, which in turn were used as seeds for particles Total-$S_r$=100 and so on. Although the CV for the ANPs is not as low as the initial Au seeds (6.3%), it remains under 15% for all samples except for the largest particles (Total-$S_r$=1600). In this case, the larger CV is caused by the presence of a smaller NP population in the 50-100 nm range, which is likely caused by nucleation of new particles during the growth process. Indeed, for a similar metallic concentration, large particles have less total surface area available for growth, resulting in a slower growth and the possibility for new nucleation [29].

The majority of these particles are spherical or slightly ellipsoid, and no elongated or "nanorod" like NPs were observed. Few particles show some facets with a slightly hexagonal or triangular shape (some examples are indicated by red arrows on FIGS. 3*e*) and *f*)), but their relative abundance is low (<5% of NPs), and they likely have a negligible effect on the suspension color or extinction spectrum. It is interesting to note that such nonspherical NPs also exist in the initial Au seeds and are probably the origin of those nonspherical ANPs.

Figure 4:
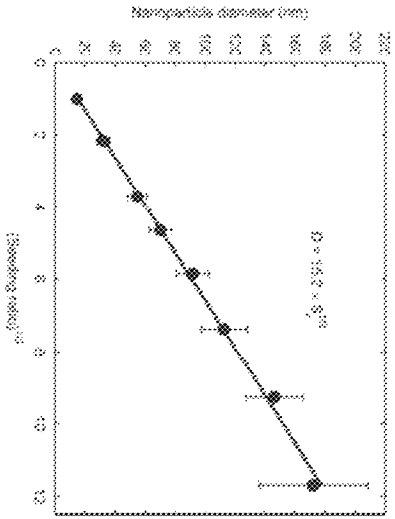
FIG. 4 Mean NP diameter showing a linear relationship with the cubic root of Total-$S_r$. Linear regression is used to compute the slope, which corresponds to the mean diameter of the Au seeds. Vertical error bars represent one standard deviation as measured by TEM. The first point represents the Au seeds, and the other points represent ANPs with 50:50 alloy shell composition.

Because of the narrow size distributions, it is expected that the mean ANP sizes of our samples will follow equation 2. Indeed, FIG. 4 shows that the mean size of the particles is linear with $S_r^{1/3}$. According to equation 2, the slope corresponds to the diameter of the initial seed particles. In this case, the slope indicates particles of 15.2 nm, in good agreement with the 15±1 nm mean diameter measured by TEM for the Au seeds (FIG. 3*a*)).

Synthesis of Composition-Controlled ANPs.

Figure 5:
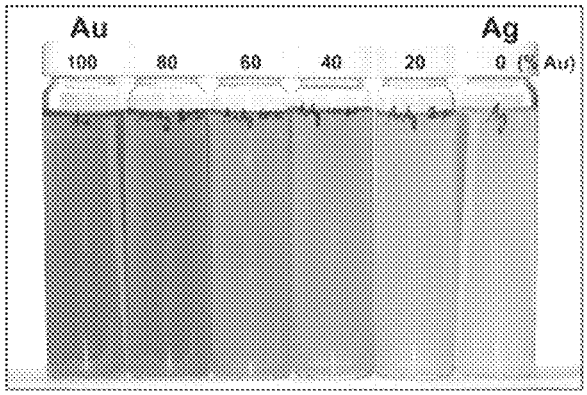
FIG. 5 Photograph of the ANPs suspensions showing the effect of alloy composition on the color of the suspension. From left to right: Au, AuAg 80:20, AuAg 60:40, AuAg 40:60, AuAg 20:80, and Ag suspensions prepared by a two-step growth with a Total-Sr=100, which corresponds to NPs with a 66 nm mean diameter.

In embodiments of the invention, ANPs with different compositions are produced by changing the ratio of Au and Ag precursor salts during synthesis. FIG. 5 shows the variation in the color of the transmitted light with the variation of the alloy composition for ANPs. The ANPs suspension color varies from red to yellow with increasing Ag content.

Figure 6:
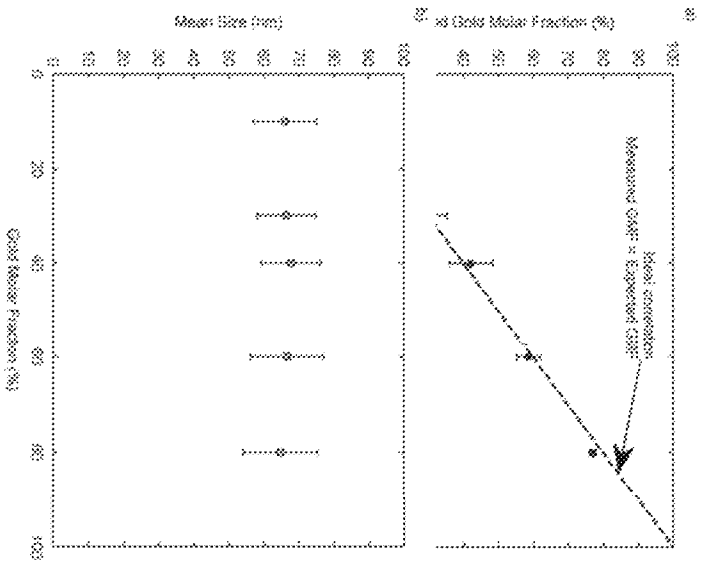
FIG. 6*a*) Mean GMF of the ANP samples as a function of the expected GMF determined by measuring the composition of a series of individual particles (approx. 15) by EDS. Vertical error bars represent one standard deviation. The dashed line represents the ideal correlation. *b*) Mean diameter for the same samples as measured by TEM. Vertical error bars represent one standard deviation, which corresponds to a CV of about 15% in these cases.
Figure 7:
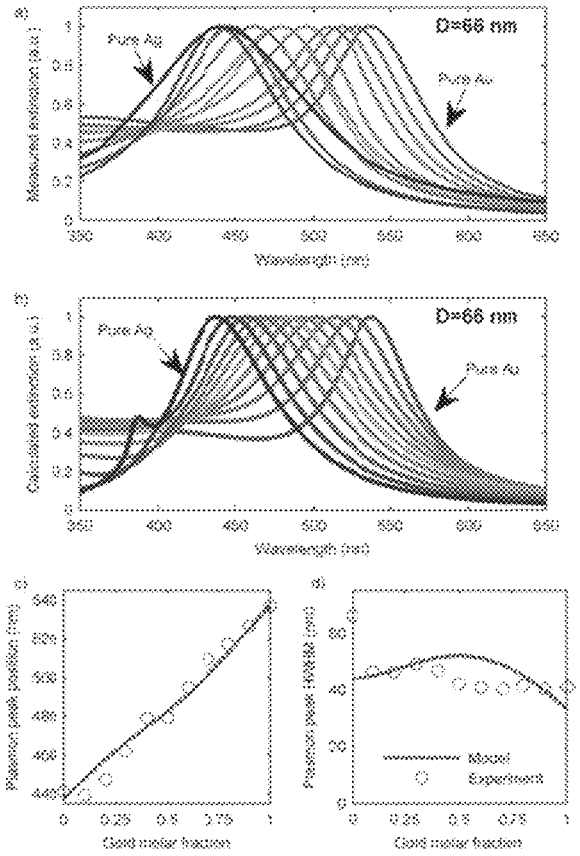
FIGS. 7*a*) Measured and *b*) calculated extinction spectra of ANPs with shell compositions varying from pure Au to pure Ag in 10% GMF increments. Agreement between *c*) the measured and the calculated plasmon peak positions and *d*) the measured and the calculated plasmon peak HWHM. ANPs were synthesized with a Total-$S_r$=100.

An average size around 66 nm with a 15% CV was measured by TEM. According to EDS measurements over many ANPs, the average gold molar fraction (GMF) is within 3 atom % of the expected value, with a standard deviation from particle to particle of 7 atom % or less; see FIG. 6, which is similar to values measured for ANPs generated by laser ablation [30]. The variation in the color of the transmitted light is due to the shifting of the extinction peak with composition. The theoretical extinction spectra of the NPs in water were computed with Mie theory [31], adapted for the treatment of coated spheres [32], using modeled composition-dependent dielectric functions for the AuAg alloy material [33]. Calculations for the plasmon peak position as a function of composition were done assuming a 15 nm Au seed core diameter and a homogeneous alloy shell with a 66 nm mean outer diameter and a 15% CV. FIG. 7 shows the measured extinction spectra for ANPs with gold molar fractions (GMF) of the alloy shell varying from 0 to 100% in 10% increments and comparison with the corresponding calculated extinction spectra. Both the measured peak positions and the half-widths half-maximum (HWHM, defined as the difference between the wavelength at the peak maximum and the wavelength at which its value has dropped to one-half of the maximum value) agree well with the calculated values, except for a slight difference in the peak position at low Au concentration and the HWHM for pure Ag. The extinction peak for pure Ag NPs is notably broader than for the other alloy compositions. For Ag, the citrate reduction technique is known to produce less spherical particles with a broader size distribution [34]. It is interesting to note that the particles have a narrower peak for the alloys. This could be due to the interaction of Au and Ag atoms producing more spherical particles [35]. Long-term stability of the ANPs is good, with no visible aggregation of the particles and only a small red shift of the extinction peak position (<5 nm) after 1 year.

Evaluation of Alloy Shell Homogeneity.

Figure 8:
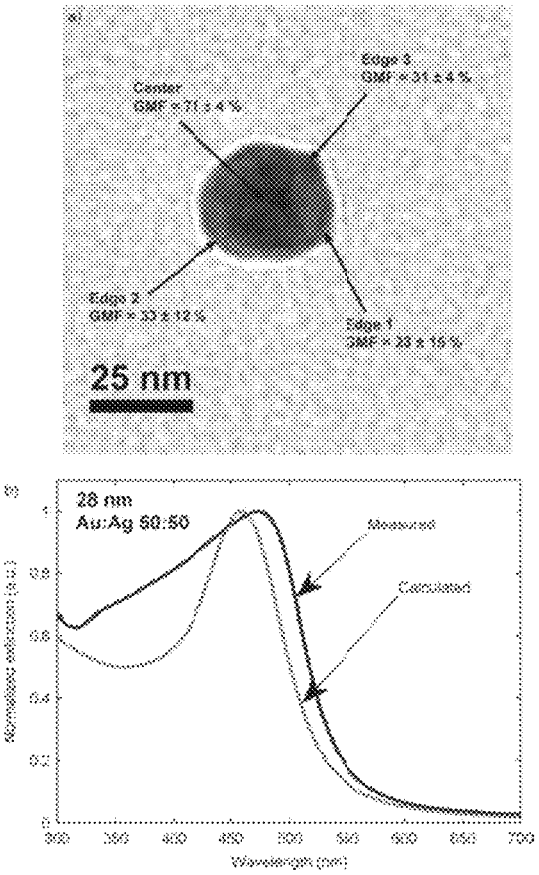
FIG. 8*a*) Alloy composition measured by EDS at different points in the 50:50 ANP. The core is Au rich, whereas the surface of the particle is Ag rich. *b*) Measured and calculated extinction spectra for the corresponding ANP suspension. The measured peak is much broader and asymmetrical relative to the theoretically expected one.

The synthesis of ANPs by chemical reduction may lead to nonhomogeneous alloy formation, with a Au-rich core and a Ag-rich surface [18,19]. For further understanding of the composition profile of the ANPs synthesized by seeded growth, the spatial alloy composition was measured by energy-dispersive X-ray spectroscopy (EDS) in a TEM on many ANPs. FIG. 8 shows a representative example of the measured atomic compositions of Au and Ag at different points of a 28 nm ANP with a 50:50 alloy shell composition and the measured extinction spectrum of the corresponding ANPs suspension. For this particle, the overall composition was measured to be within 2% of the expected 55:45 AuAg composition (the pure Au core represents 10% of the particle volume; the remaining 90% is the 50:50 alloy shell). As expected from the literature, we observed an Ag-rich surface with an Au-rich core. Although the simple presence of an Au seed at the core of the particle explains the higher Au content measured at the center of the particle, the Ag-rich surface may be explained by an inhomogeneous alloy composition in the shell; otherwise, the measurement would have been 50:50 at these points.

Since the composition is not homogeneous, it is important to understand the effect on the optical properties. Most ANPs present a symmetrical plasmon peak. However, for small (~30 nm) ANPs produced by the seeded growth co-reduction technique of this disclosure, the measured extinction spectrum is nonsymmetric; see FIG. 8*b*). The theoretical extinction spectrum calculated by Mie theory for a 28 nm diameter ANP with a homogeneous 50:50 alloy shell should be symmetrical (green line, FIG. 8*b*)). The nonsymmetrical extinction spectrum probably results from the not homogeneous alloy composition, with a GMF dependent on the radial position.

Mie theory may account for discrete volumes, each of which has a homogeneous composition. The effect of nonhomogeneous alloy shell was computed by modeling the ANPs as a 13 nm Au seed core with 50 concentric homogeneous alloy shells of equal thicknesses but varying compositions, as represented schematically in FIG. 9*a*). The composition profile was controlled so that the overall mean shell composition was equal to that of the experimental ANPs.

Figure 10:
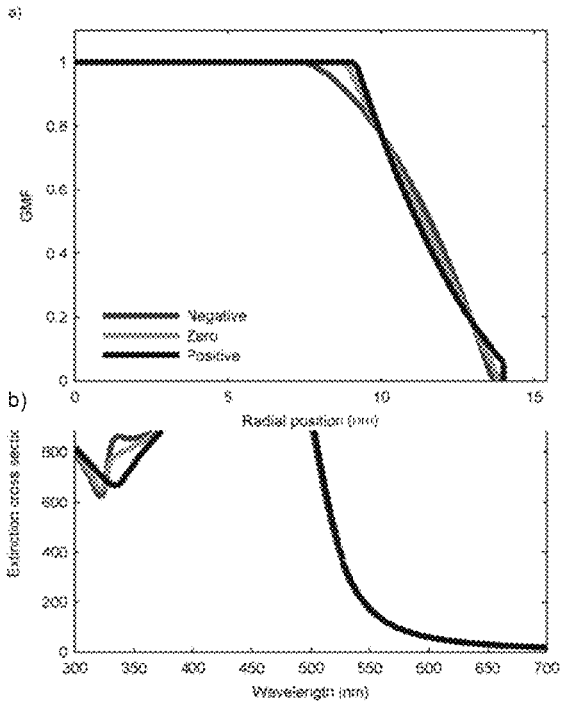
FIG. 10 Effect of the addition of a small second order term on a) the profile composition and b) its associated extinction spectrum for 28 nm diameter 50:50 AuAg ANPs. A negative (red curves) or positive (blue curves) second-order term does not yield significantly different extinction spectra when compared to a simple linear profile (green curves). Thus, the approximation of a linear composition profile is justified.

The measured extinction spectrum was fitted by assuming a quadratic dependence of the GMF on the radial position. Although the initial fitting algorithm permitted a quadratic dependence, it converged to an almost linear dependence, with a higher Au content near the Au core and an Ag-rich surface. As it turns out, the linear term is important; the second order coefficient slightly affects the extinction spectrum; see FIG. 10. For this reason and for the sake of simplicity, we fitted the radial composition dependence using a simple linear fit. It should be noted that the fitting algorithm prevented unphysical values of GMF by restricting its values between 0 and 1. It also restricted the average composition of the shell to a fixed composition (50% Au in this case).

Figure 9:
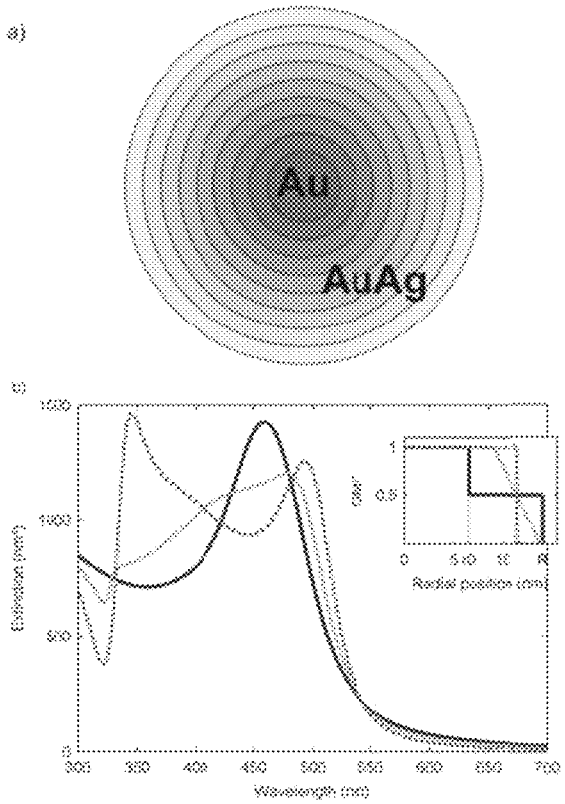
FIG. 9*a*) Schematic of the modeling of inhomogeneous alloy shell composition with concentric shells of homogeneous compositions. *b*) Calculated extinction spectra for the ideal case of a homogeneous profile (slope=0, blue line), a linear profile (green line), and a core-shell structure (infinite slope, red line), showing the effect of the average composition slope on the extinction spectrum. (Inset) Corresponding radial composition profiles. In this example, $r_0$=7.5 nm and R=14 nm are the radii of the Au seed and the ANP, respectively.

Because of the restriction on the average shell composition, the linear model that was used for fitting the peaks has only one degree of liberty: the slope of the composition profile. FIG. 9*b*) shows how the slope affects the shape and width of the plasmon peak in the case of a homogeneous shell (zero slope, blue line), a linear profile (nonzero slope, green line), and a core-shell profile (infinite slope, red line). For a zero slope, the peak is symmetrical and the narrowest. As the slope increases, the peak broadens and loses symmetry until the slope becomes infinite and the structure becomes that of an AuAg core-shell. In this case, the extinction spectrum shows two distinct peaks.

Figure 11:
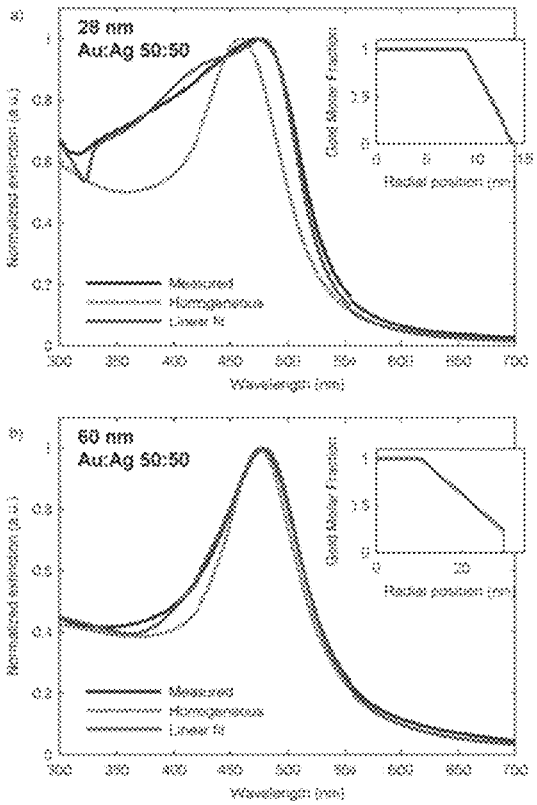
FIG. 11 Comparison of the measured (blue line) and theoretical extinction spectra for homogeneous (green line) and linear fit of the alloy composition (red line) for a) 28 nm and b) 60 nm ANPs with a 50:50 alloy shell. Insets show the radial GMF fitted in each case.

FIG. 11 shows the good agreement using this fitted composition dependence compared to the measured spectrum. As observed for small NPs (28 nm), the extinction peak is broad and nonsymmetrical but may be modeled accurately by simple linear composition dependence (FIG. 11*a*)). For larger NPs (60 nm), the measured extinction peak is symmetrical but slightly broader than the theoretical peak for homogeneous alloy shell (FIG. 11*b*)). Using a similar fit with linear composition dependence, the measured peak may be modeled accurately.

Although peak asymmetry broadens the plasmon peak, which has a detrimental effect in many applications requiring narrow peaks, it is interesting to note that this effect is only important for small particles (<50 nm). Therefore, for applications that require large NPs, the inhomogeneous composition has an almost negligible effect on the plasmon peak, and thus, it is not a necessity to synthesize ANPs with homogeneous composition. Furthermore, for large NPs, alloy inhomogeneity may be neglected in the calculation of the optical properties. Therefore, the results presented in FIG. 7 remain valid even if the alloy shell was considered homogeneous.

The Ag-rich surface is probably caused by the galvanic replacement of Ag atoms at the NP surface by Au ions during particle growth. Because of the higher reduction potential of Au compared to Ag, $Au^{3+}$ ions may oxidize $Ag^0$ atoms at the particle surface to $Ag^+$ ions, leading to their release into the solution and the $Au^{3+}$ ions being reduced to $Au^0$ at the particle surface, according to the following reaction [10,13]

$$AU^{3+}(aq)+3Ag^0(S)\rightarrow AU^0(S)+Ag^+(aq) \quad (3)$$

Figure 12:
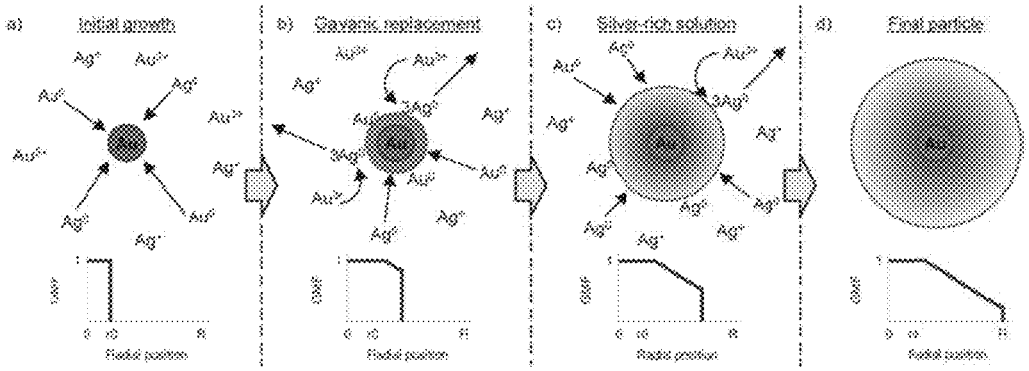
FIG. 12 Schematic view of the growth mechanism for the example of a 50:50 alloy shell, explaining the Au-rich core and the Ag-rich surface. a) Au and Ag ions are initially at the same concentration in the solution and both grow on the seed surface. b) After the initial deposition of Au and Ag atoms, $Au^{3+}$ ions in the solution may oxidize and replace Ag atoms at the surface by the galvanic replacement reaction (curved arrows), resulting in a higher net deposition of Au relative to Ag, which explains the observed higher Au content near the seed. c) Later in the growth, the remaining ions in the solution are mostly Ag ions, explaining the Ag-rich surface of the final particle d). Insets show the schematic view of the radial Au composition profile at each represented growth steps.

This phenomenon is used, for example, to produce hollow Au NPs from Ag NPs [36] or Au nanocages from Ag nanocubes [37,38]. In our case, hollow NPs are not formed because the reduction by citrate is taking place simultaneously and continuously adds Au and Ag atoms to fill the vacancies. However, the galvanic replacement leads to a higher net growth rate of Au and a lower net growth rate of Ag at the beginning of alloy shell growth. This phenomenon results in a gradual increase of the Ag to Au ratio into the solution during growth, explaining the higher Au concentration near the seed and the Ag-rich surface; see FIG. 12.

CONCLUSION

According to embodiments of the invention, a synthesis method for AuAg ANPs with controlled size and composition using a combination of co-reduction and seeded growth was developed. Compared to other methods limited to ANPs with about 30 nm mean diameter, the seeded growth approach according to the invention produces ANPs with a mean diameter that may be controlled between about 30 and about 200 nm with a CV of less than about 15%, indicating a monodispersed suspension. The alloy shell composition of the ANPs according to the invention may not be homogeneous and may affect the extinction peak for small ANPs (for example <about 30 nm), but this effect is negligible for larger ANPs (for example >about 60 nm).

Due to their composition-controlled plasmon peak, such ANPs present great interest in multiplexed biological imaging [20]. The larger ANPs (for example 22 about 50 nm) are especially interesting because of their strong scattering of light. The ANPs of the invention, as pure Au and Ag nanoparticles, may be functionalized with antibodies to target specific biomarkers. Also, the surface of the ANPs may be functionalized with stabilizing polymers such as polyethylene glycol (PEG) and polyvinylpyrrolidone (PVP). Moreover, Raman-active molecules and dyes may be added to their surface for enhanced Raman scattering (SERS).

In embodiments of the invention and as described above, the process is performed at high temperature using a high-temperature reducing agent such as sodium citrate. In other embodiments of the invention, the process may be performed at ambient temperature, and reducing agents such as ascorbic acid, hydroquinone, hydroxylamine and the like may be used.

As will be understood by a skilled person, other alloy nanoparticles comprising two metals may be obtained by the process of the invention, such as for example gold-copper or silver-copper alloy nanoparticles. Also, such alloy nanoparticles may involve metals such as platinum or palladium.

Also as will be understood by a skilled person, alloy nanoparticles comprising more than two metals may be obtained by the process of the invention such as for example gold-silver-copper alloy nanoparticles. Also, such alloy nanoparticles may involve metals such as platinum or palladium.

Moreover, as will be understood by a skilled person, any one of the metals or an alloy thereof may be used as initial seed particles. For example in the preparation of gold-silver alloy nanoparticle either gold particles, silver particles or gold-silver alloy particles may be used as initial seed material.

Although the present invention has been described hereinabove by way of specific embodiments thereof, it can be modified, without departing from the spirit and nature of the subject invention as defined in the appended claims.

The present description refers to a number of documents, the content of which is herein incorporated by reference in their entirety.

REFERENCES (1) Stockman, M. I. Nanoplasmonics: The Physics Behind the Applications. *Phys. Today* (2011), 64, 39.

(2) Garcia, M. A. Surface Plasmons in Metallic Nanoparticles: Fundamentals and Applications. *J. Phys. D: Appl. Phys.* (2011), 44, 283001.

(3) Jain, P. K.; Lee, K. S.; El-Sayed, I. H.; El-Sayed, M. A. Calculated Absorption and Scattering Properties of Gold Nanoparticles of Different Size, Shape, and Composition: Applications in Biological Imaging and Biomedicine. *J. Phys. Chem. B* (2006), 110, 7238-7248.

(4) Murphy, C. J.; Sau, T. K.; Gole, A. M.; Orendorff, C. J.; Gao, J.; Gou, L.; Hunyadi, S. E.; Li, T. Anisotropic Metal Nanoparticles: Synthesis, Assembly, and Optical Applications. *J. Phys. Chem. B* (2005), 109, 13857-13870.

(5) Tiedemann, D.; Taylor, U.; Rehbock, C.; Jakobi, J.; Klein, S.; Kues, W. A.; Barcikowski, S.; Rath, D. Reprotoxicity of Gold, Silver, and Gold-Silver Alloy Nanoparticles on Mammalian Gametes. *Analyst* (2014), 139, 931-942.

(6) Besner, S.; Meunier, M. Femtosecond Laser Synthesis of AuAg Nanoalloys: Photoinduced Oxidation and Ions Release. *J. Phys. Chem. C* (2010), 114, 10403-10409.

(7) Radziuk, D. V.; Zhang, W.; Shchukin, D.; Möhwald, H. Ultrasonic Alloying of Preformed Gold and Silver Nanoparticles. *Small* (2010), 6, 545-553.

(8) Peng, Z.; Spliethoff, B.; Tesche, B.; Walther, T.; Kleinermanns, K. Laser-Assisted Synthesis of Au—Ag Alloy Nanoparticles in Solution. *J. Phys. Chem. B* (2006), 110, 2549-2554.

(9) Grade, S.; Eberhard, J.; Jakobi, J.; Winkel, A.; Stiesch, M.; Barcikowski, S. Alloying Colloidal Silver Nanoparticles with Gold Disproportionally Controls Antibacterial and Toxic Effects. *Gold Bull.* (2014), 47, 83-93.

(10) Gonzalez, C. M.; Liu, Y.; Scaiano, J. C. Photochemical Strategies for the Facile Synthesis of Gold-Silver Alloy and Core-Shell Bimetallic Nanoparticles. *J. Phys. Chem. C* (2009), 113, 11861-11867.

(11) Liu, S.; Chen, G.; Prasad, P. N.; Swihart, M. T. Synthesis of Monodisperse Au, Ag, and Au—Ag Alloy Nanoparticles with Tunable Size and Surface Plasmon Resonance Frequency. *Chem. Mater.* (2011), 23, 4098-4101.

(12) Zhang, Q.; Xie, J.; Liang, J.; Lee, J. Y. Synthesis of Monodisperse Ag—Au Alloy Nanoparticles with Independently Tunable Morphology, Composition, Size, and Surface Chemistry and Their 3-D Superlattices. *Adv. Funct. Mater.* (2009), 19, 1387-1398.

(13) Shore, M. S.; Wang, J.; Johnston-Peck, A. C.; Oldenburg, A. L.; Tracy, J. B. Synthesis of Au(Core)/Ag(Shell) Nanoparticles and Their Conversion to AuAg Alloy Nanoparticles. *Small* (2011), 7, 230-234.

(14) Rodriguez-González, B.; Burrows, A.; Watanabe, M.; Kiely, C. J.; Liz Marzán, L. M. Multishell Bimetallic AuAg Nanoparticles: Synthesis, Structure and Optical Properties. *J. Mater. Chem.* (2005), 15, 1755.

(15) Link, S.; Wang, Z. L.; El-Sayed, M. A. Alloy Formation of Gold-Silver Nanoparticles and the Dependence of the Plasmon Absorption on Their Composition. *J. Phys. Chem. B* (1999), 103, 3529-3533.

(16) Sánchez-Ramirez, J. F.; Pal, U.; Nolasco-Hernández, L.; Mendoza-Álvarez, J.; Pescador-Rojas, J. A. Synthesis and Optical Properties of Au—Ag Alloy Nanoclusters with Controlled Composition. *J. Nanomater.* (2008), 2008, 1-9.

(17) Mallin, M. P.; Murphy, C. J. Solution-Phase Synthesis of Sub-10 Nm Au—Ag Alloy Nanoparticles. *Nano Lett.* (2002), 2, 1235-1237.

(18) Mahl, D.; Diendorf, J.; Ristig, S.; Greulich, C.; Li, Z.-A.; Farle, M.; Köller, M.; Epple, M. Silver, Gold, and Alloyed Silver-gold Nanoparticles: Characterization and Comparative Cell-Biologic Action. *J. Nanopart. Res.* (2012), 14, 1153.

(19) Li, T.; Albee, B.; Alemayehu, M.; Diaz, R.; Ingham, L.; Kamal, S.; Rodriguez, M.; Bishnoi, S. W. Comparative Toxicity Study of Ag, Au, and Ag—Au Bimetallic Nanoparticles on Daphnia Magna. *Anal. Bioanal. Chem.* (2010), 398, 689-700.

(20) Patskovsky, S.; Bergeron, E.; Rioux, D.; Simard, M.; Meunier, M. Hyperspectral Reflected Light Microscopy of Plasmonic Au/Ag Alloy Nanoparticles Incubated as Multiplex Chromatic Biomarkers with Cancer Cells. *Analyst* (2014), 139, 5247-5253.

(21) Patskovsky, S.; Bergeron, E.; Rioux, D.; Meunier, M. Wide-Field Hyperspectral 3D Imaging of Functionalized Gold Nanoparticles Targeting Cancer Cells by Reflected Light Microscopy. *J. Biophotonics* (2014), DOI: 10.1002/jbio.201400025.

(22) Patskovsky, S.; Bergeron, E.; Meunier, M. Hyperspectral Darkfield Microscopy of PEGylated Gold Nanoparticles Targeting CD44-Expressing Cancer Cells. *J. Biophotonics* (2013), 6, 1-6.

(23) Turkevich, J.; Stevenson, P. C.; Hillier, J. A Study of the Nucleation and Growth Processes in the Synthesis of Colloidal Gold. *Discuss. Faraday Soc.* (1951), 11, 55.

(24) Frens, G. Controlled Nucleation for the Regulation of the Particle Size in Monodisperse Gold Suspensions. *Nat. Phys. Sci.* (1973), 241, 20-22.

(25) Ji, X.; Song, X.; Li, J.; Bai, Y.; Yang, W.; Peng, X. Size Control of Gold Nanocrystals in Citrate Reduction: The Third Role of Citrate. *J. Am. Chem. Soc.* (2007), 129, 13939-13948.

(26) Brown, K. R.; Natan, M. J. Hydroxylamine Seeding of Colloidal Au Nanoparticles in Solution and on Surfaces. *Langmuir* (1998), 14, 726-728.

(27) Brown, K. R.; Walter, D. G.; Natan, M. J. Seeding of Colloidal Au Nanoparticle Solutions. 2. Improved Control of Particle Size and Shape. *Chem. Mater.* (2000), 12, 306-313.

(28) Perrault, S. D.; Chan, W. C. W. Synthesis and Surface Modification of Highly Monodispersed, Spherical Gold Nanoparticles of 50-200 nm. *J. Am. Chem. Soc.* (2009), 131, 17042-17043.

(29) Ziegler, C.; Eychmüer, A. Seeded Growth Synthesis of Uniform Gold Nanoparticles with Diameters of 15-300 nm. *J. Phys. Chem. C* (2011), 115, 4502-4506.

(30) Neumeister, A.; Jakobi, J.; Rehbock, C.; Moysig, J.; Barcikowski, S. Monophasic Ligand-Free Alloy Nanoparticle Synthesis Determinants during Pulsed Laser Ablation of Bulk Alloy and Consolidated Microparticles in Water. *Phys. Chem. Chem. Phys.* (2014), 16, 23671-23678.

(31) Mie, G. Beiträge Zur Optik Trüber Medien, Speziell Kolloidaler Metallösungen. *Ann. Phys.* (1908), 330, 377-445.

(32) Le Ru, E. C.; Etchegoin, P. G. Principles of Surface-Enhanced Raman Spectroscopy and Related Plasmonic Effects; Elsevier: Amsterdam, 2009.

(33) Rioux, D.; Vallières, S.; Besner, S.; Muñoz, P.; Mazur, E.; Meunier, M. An Analytic Model for the Dielectric Function of Au, Ag, and Their Alloys. *Adv. Opt. Mater.* (2014), 2, 176-182.

(34) Wan, Y.; Guo, Z.; Jiang, X.; Fang, K.; Lu, X.; Zhang, Y.; Gu, N. Quasi-Spherical Silver Nanoparticles: Aqueous Synthesis and Size Control by the Seed-Mediated Lee-Meisel Method. *J. Colloid Interface Sci.* (2013), 394, 263-268.

(35) Xia, H.; Bai, S.; Hartmann, J.; Wang, D. Synthesis of Monodisperse Quasi-Spherical Gold Nanoparticles in Water via silver(I)-Assisted Citrate Reduction. *Langmuir* 2010, 26, 3585-3589.

(36) Fairbairn, N.; Christofidou, A.; Kanaras, A. G.; Newman, T. A; Muskens, O. L. Hyperspectral Darkfield Microscopy of Single Hollow Gold Nanoparticles for Biomedical Applications. *Phys. Chem. Chem. Phys.* (2013), 15, 4163-4168.

(37) Skrabalak, S. E.; Chen, J.; Au, L.; Lu, X.; Li, X.; Xia, Y. Gold Nanocages for Biomedical Applications. *Adv. Mater.* (2007), 19, 3177-3184.

(38) Chen, J.; McLellan, J. M.; Siekkinen, A.; Xiong, Y.; Li, Z.-Y.; Xia, Y. Facile Synthesis of Gold-Silver Nanocages with Controllable Pores on the Surface. *J. Am. Chem. Soc.* (2006), 128, 14776-14777.

(39) Russier-Antoine, I.; Bachelier, G.; Sablonière, V.; Duboisset, J.; Benichou, E.; Jonin, C.; Bertorelle, F.; Brevet, P.-F. Surface Heterogeneity in Au—Ag Nanoparticles Probed by Hyper-Rayleigh Scattering. *Physical Review B* (2008), 78, 035436.

(40) Navarro, J. R. G.; Werts, M. H. V. Resonant Light Scattering Spectroscopy of Gold, Silver, and Gold-Silver Alloy Nanoparticles and Optical Detection in microfluidic Channels. *Analyst* (2013), 138, 583-592.

The invention claimed is:

1. A material comprising alloy nanoparticles made of at least two metals, wherein:

a core of each alloy nanoparticle is made of Au and a shell of the alloy nanoparticle is made of the Au—Ag alloy, wherein the shell is grown around the core which is constituted of a nanoparticle of an initial seed;

a mean diameter of the seed nanoparticles is about 15 nm and a mean diameter of the alloy nanoparticles is between about 30 nm and 200 nm as measured by transmission electron microscopy (TEM); and the alloy nanoparticles have a coefficient of variation smaller than about 15%.

2. The material of claim 1, wherein the mean diameter of the alloy nanoparticles is between about 50 nm and 150 nm.

3. The material of claim 1, wherein the mean diameter of the alloy nanoparticles is between about 65 nm and 120 nm.

4. The material of claim 1, wherein the alloy nanoparticles are substantially spherical and monodispersed in aqueous solution.

5. The material of claim 1, wherein the alloy nanoparticles have an ellipticity between about 1.0 and 1.5.

6. The material of claim 1, wherein the alloy nanoparticles are suitable for attachment to and/or interaction with biological agents including: antibodies, stabilizing polymers such as polyethylene glycol (PEG) and polyvinylpyrrolidone (PVP), Raman-active molecules and dyes.

7. The material of claim 1, wherein the mean diameter of the alloy nanoparticles is between about 50 nm to 100 nm.

* * * * *